United States Patent [19]

Bodine

[11] Patent Number: 4,512,401

[45] Date of Patent: Apr. 23, 1985

[54] METHOD FOR FORMING A CEMENT ANNULUS FOR A WELL

[76] Inventor: Albert G. Bodine, 7877 Woodley Ave., Van Nuys, Calif. 91406

[21] Appl. No.: 382,700

[22] Filed: May 27, 1982

Related U.S. Application Data

[63] Continuation-in-part of Ser. No. 344,626, Feb. 1, 1982.

[51] Int. Cl.[3] ..... E21B 33/14

[52] U.S. Cl. ..... 166/249; 166/286; 166/177

[58] Field of Search ..... 166/249, 286, 177, 285

[56] References Cited

U.S. PATENT DOCUMENTS

| | | | |
|---|---|---|---|
| 1,563,520 | 12/1925 | Owen | 166/285 |
| 3,239,005 | 3/1966 | Bodine | 166/286 |
| 3,557,875 | 1/1971 | Solum et al. | 166/177 X |
| 4,093,028 | 6/1978 | Brandon | 166/286 X |

OTHER PUBLICATIONS

Uren, Lester Charles, *Petroleum Production Engineering,* McGraw-Hill Book Co., New York, 1956, pp. 510-511.

*Primary Examiner*—Stephen J. Novosad
*Assistant Examiner*—Michael Starinsky
*Attorney, Agent, or Firm*—Edward A. Sokolski

[57] ABSTRACT

A method for forming an annulus around the outer wall of a well casing to provide a good impervious seal around such casing. A wiper of a flexible soft material which mates with the inner bore of the casing is first placed in the casing at the top thereof. Cement is pumped into the casing on top of the wiper, forcing it down to the bottom of the casing, the wiper carrying mud and other foreign material with it and out of the casing. Sonic energy at a relatively low frequency (typically 15-200 Hz) is applied to the casing. A second wiper which mates with the inner walls of the casing is installed therein, this second wiper being of a rigid, relatively inflexible material. While the sonic energy is being applied, mud or water is fed into the casing on top of the second wiper to force this wiper against the column of cement such that the first wiper is forced out the bottom of the casing and the column of cement forced into the spacing between the casing and the well bore, thereby forming an annulus therearound which rises from the bottom to the top of the casing.

7 Claims, 4 Drawing Figures

METHOD FOR FORMING A CEMENT ANNULUS FOR A WELL

This application is a continuation-in-part of my application Ser. No. 344,626, filed Feb. 1, 1982.

This invention relates to the servicing of oil wells to form a cement annulus around the casings thereof, and more particularly to an improved technique employing sonic energy to facilitate the formation of such an annulus.

In connection with the finishing of deep wells, such as in the case of oil wells, it is standard practice to place a lining in the form of a steel casing in the well bore, this casing generally including sections which are threadably joined together and lowered into the well immediately after it is drilled and while it is still full of drill mud. This casing is utilized to prevent side wall caving and provides a strong wall to withstand jolts from subsequent mechanical operations, thus keeping the well open. After the casing has been installed in position, concrete is often poured into the casing and allowed to rise up along the outer walls thereof to form a sealing annulus to prevent fluids from leaking up the well around the outer walls of the casing. For such a cement annulus to be effective, it must provide an impervious seal between the walls of the well bore and the well casing. With techniques of the prior art, it has been found that the rising annulus of cement often tends to flow around masses of mud, thus leaving large voids in the cement annulus after it has hardened in place. This permits unwanted fluids to leak up around the casing annulus, such unwanted fluids passing into the casing through perforation holes therein in certain regions thereof, causing contamination of the well product. Further, where the bore is slanted, the casing is caused to bear against the wall of the bore which tends to prevent the uniform migration of the cement around the casing. It is to be noted that an effective seal around the casing is particularly important in situations where hydraulic fracturing is employed to improve well production by vigorously pumping a highly pressurized liquid down the casing. This is so because the fracturing is severely hampered if the casing is not properly sealed as the fracturing pressure is severely dissipated in such instances.

To alleviate this situation, attempts have been made in the prior art to obtain a good sealing annulus by reciprocally rotating the casing while the cement is being poured or by jarring the casing, but these techniques have been found to be inadequate to remedy the aforementioned conditions.

The method of the present invention solves the aforementioned difficulty by applying low frequency sonic energy to the area of the cement while it is being poured in place to form a highly effective sealing cement annulus around the casing. This sonic action tends to fluidize the particles of cement and mud which might form in masses around the casing such that the cement fills the area around the casing in a uniform manner and mixes with any such mud masses to form an aggregate mass in the nature of concrete. Further, the sonic energy causes a certain amount of lateral vibration of the casing relative to the well bore. This periodically provides spaces between the casing and portions of the bore against which the casing may bear (particularly in situations of slanted bores), thus clearing the way for the upward flow of cement through these tightly pinched regions.

Further, the sonic action tends to scrub the outside surface of the casing, in effect rubbing against the cement, thereby releasing and removing gas bubbles, dirt, rust, scale and other foreign particles from the casing surface. This achieves improved wetting of such surface with the cement so as to improve the sealing bond.

In carrying out the method of the invention, a soft flexible wiper is first forced down the casing by a column of cement poured into the casing. The wiper drives accumulated mud out of the casing and down to the bottom of the well bore and is finally itself driven out the bottom of the casing by the cement column. A second rigid wiper is then placed in the casing on top of the column of cement and water and/or mud pumped into the casing to force the wiper down against the cement column, thereby forcing the column out of the casing and up along the side of the casing to form an annulus therearound. While the cement is being driven out of the casing, sonic energy, preferably at a frequency such as to cause standing wave resonant vibration of the casing, is applied to the casing, the sonic energy effectively forming a uniform annulus around the casing which forms a good sealing bond with the casing.

It is therefore an object of this invention to facilitate the forming of a cementitious annulus seal around a well casing.

It is still a further object of this invention to avoid the forming of non-cementitious pockets in the sealing of a well casing with a cement annulus.

It is still another object of this invention to improve the formation of a cement annulus around a well casing where such casing is installed in a slanted well bore.

Other objects of the invention will become apparent as the description proceeds in connection with the accompanying drawings of which:

Figure 1:
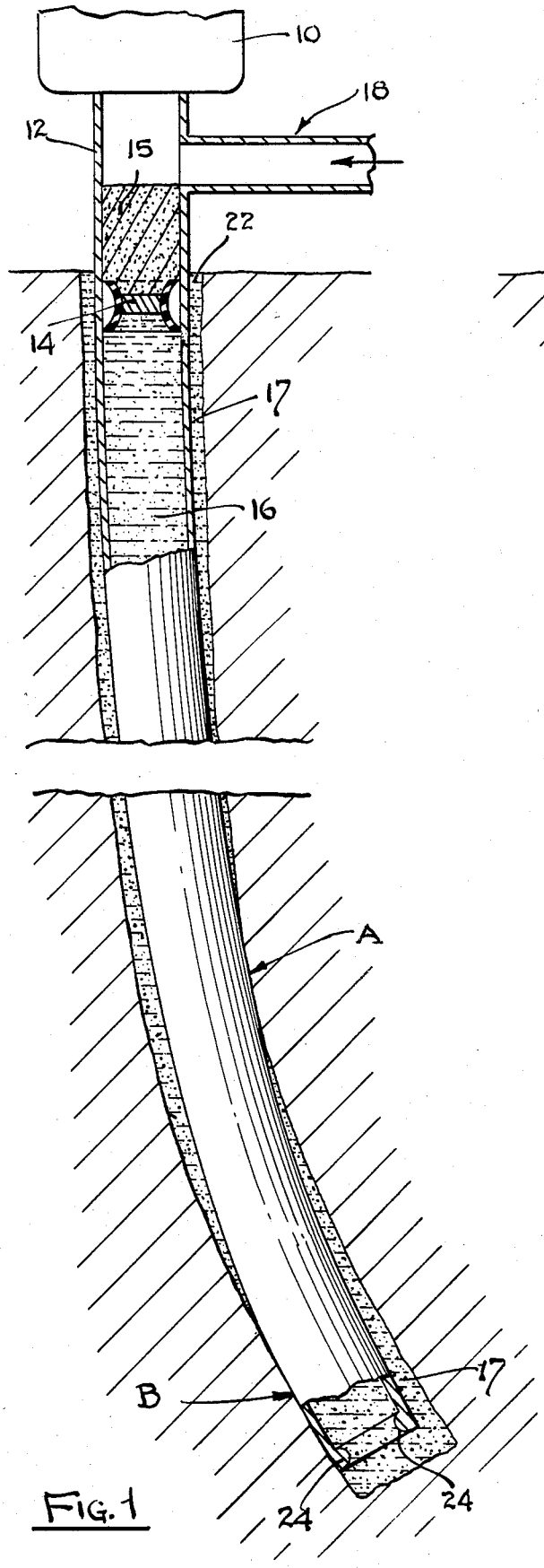
FIG. 1 is a schematic drawing illustrating the initial steps in carrying out the method of the invention.

It has been found most helpful in analyzing the device of this invention to analogize the acoustically vibrating circuit utilized to an equivalent electrical circuit. This sort of approach to analysis is well known to those skilled in the art and is described, for example, in Chapter 2 of "Sonics" by Hueter and Bolt, published in 1955 by John Wiley and Sons. In making such an analogy, force F is equated with electrical voltage E, velocity of vibration u is equated with electrical current i, mechanical compliance $C_m$ is equated with electrical capacitance C, mass M is equated with electrical inductance L, mechanical resistance (friction) $R_m$ is equated with electrical impedance $Z_e$.

Thus, it can be shown that if a member is elastically vibrated by means of an acoustical sinusoidal force $F_0 \sin \omega t$ ($\omega$ being equal to $2\pi$ times the frequency of vibration), $$Z_m = R_m + j(\omega M - (1/\omega C_m) \quad (1).$$

Where $\omega M$ is equal to $(1/\omega C_m)$, a resonat condition exists, and the effective mechanical impedance $Z_m$ is at a minimum and is equal to the mechanical resistance $R_m$, the reactive components $\omega M$ and $(1/\omega C_m)$ cancelling each other out. Under such a resonant condition, velocity of vibration is at a maximum, power factor is unity, and energy is more efficiently delivered to a load to which the resonant system may be coupled.

It is important to note the significance of the attainment of high acoustical "Q" in the resonant system being driven to increase the effliciency of the vibration thereof and to provide a maximum amount of power. As for an equivalent electrical circuit, the "Q" of an acoustically vibrating system is defined as the sharpness of resonance thereof and is indicative of the ratio of the energy stored in each vibration cycle to the energy used in each such cycle. "Q" is mathematically equated to the ratio between $\omega M$ and $R_m$. Thus, the effective "Q" of the vibrating system can be maximized to make for highly efficient, high-amplitude vibration by minimizing the effect of friction in the system and/or maximizing the effect of mass in such system.

In considering the significance of the parameters described in connection with equation (1), it should be kept in mind that the total effective resistance, mass, and compliance in the acoustically vibrating system are represented in the equation and that these parameters may be distributed throughout the system rather than being lumped in any one component or portion thereof.

It is also to be noted that orbiting mass oscillators are utilized in the implementation of the invention that automatically adjust their output frequency and phase to maintain resonance with changes in the characteristics of the load. Thus, in the face of changes in the effective mass and compliance presented by the load with changes in the conditions of the work material as it is sonically excited, the system automatically is maintained in optimum resonant operation by virtue of the "lock-in" characteristics of the applicant's unique orbiting mass oscillators. Furthermore, in this connection the orbiting mass oscillator automatically changes not only its frequency but its phase angle and therefore its power factor with changes in the resistive impedance load, to assure optimum efficiency of operation at all times. The vibrational output from such orbiting mass oscillators also tends to be constrained by the resonator to be generated along a controlled predetermined coherent path to provide maximum output along a desired axis.

Referring now to FIG. 1, the initial steps in carrying out the method of the invention are illustrated schematically. Casing string 12 is installed in well bore 17, the bore in this instance being slanted with portions of the casing at "A" and "B" bearing closely against the walls of the bore. A column of water and mud 16 is contained within the casing. Installed on top of this column is a flexible wiper member 14 which may be of a suitable rubber or neoprene material and which is in the form of a disc having a diameter which matches that of the inner diameter of casing 12. A sonic oscillator 10, preferably of the type described in my co-pending application Ser. No. 344,626, is installed on the top of casing 12 in a manner such that it is capable of transferring its sonic energy output to the casing. Cement 15 is pumped into casing 12 through inlet 18, the cement forming a column over wiper 14 which drives the wiper downwardly such that it forces the mud and water down the casing, out through the bottom thereof, and up along the annulus formed in the bore around the casing from which such mud and water is ejected from the top 22 of the bore. During these initial steps of the invention, i.e., while the mud is first being forced out of the casing, the sonic oscillator 10 is usually left dormant. However, sonic energy may be employed during these steps to facilitate the loosening of the mud so that it can more easily be driven out of the casing and bore hole annulus along the outer walls of the casing.

Figure 2:
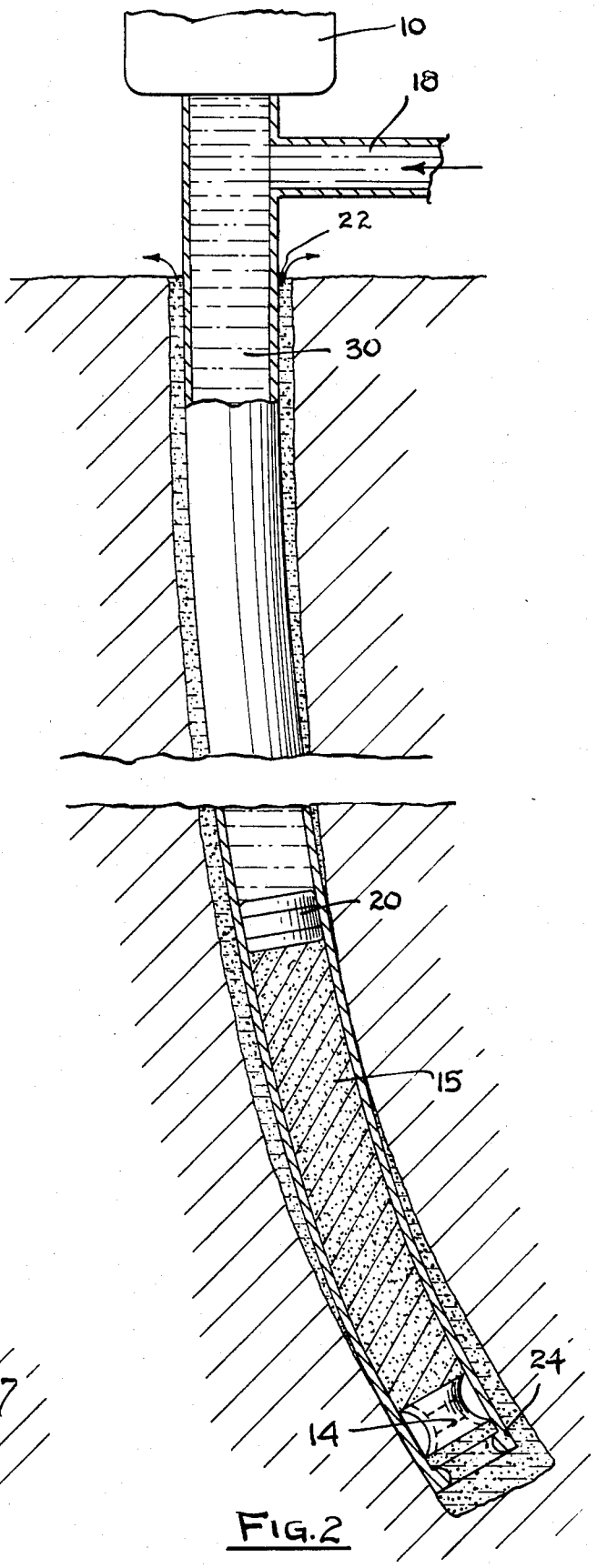
FIG. 2 is a schematic drawing illustrating further steps of the method of the invention.

Referring now to FIG. 2, flexible wiper 14 can be seen as it nears the very bottom of the casing where an annular stop member 24 for stopping the rigid wiper 20 (as later to be described) is provided. The flexible wiper 14 is permitted to be driven past stop member 24 and out of the casing as shown in FIG. 3.

Figure 3:
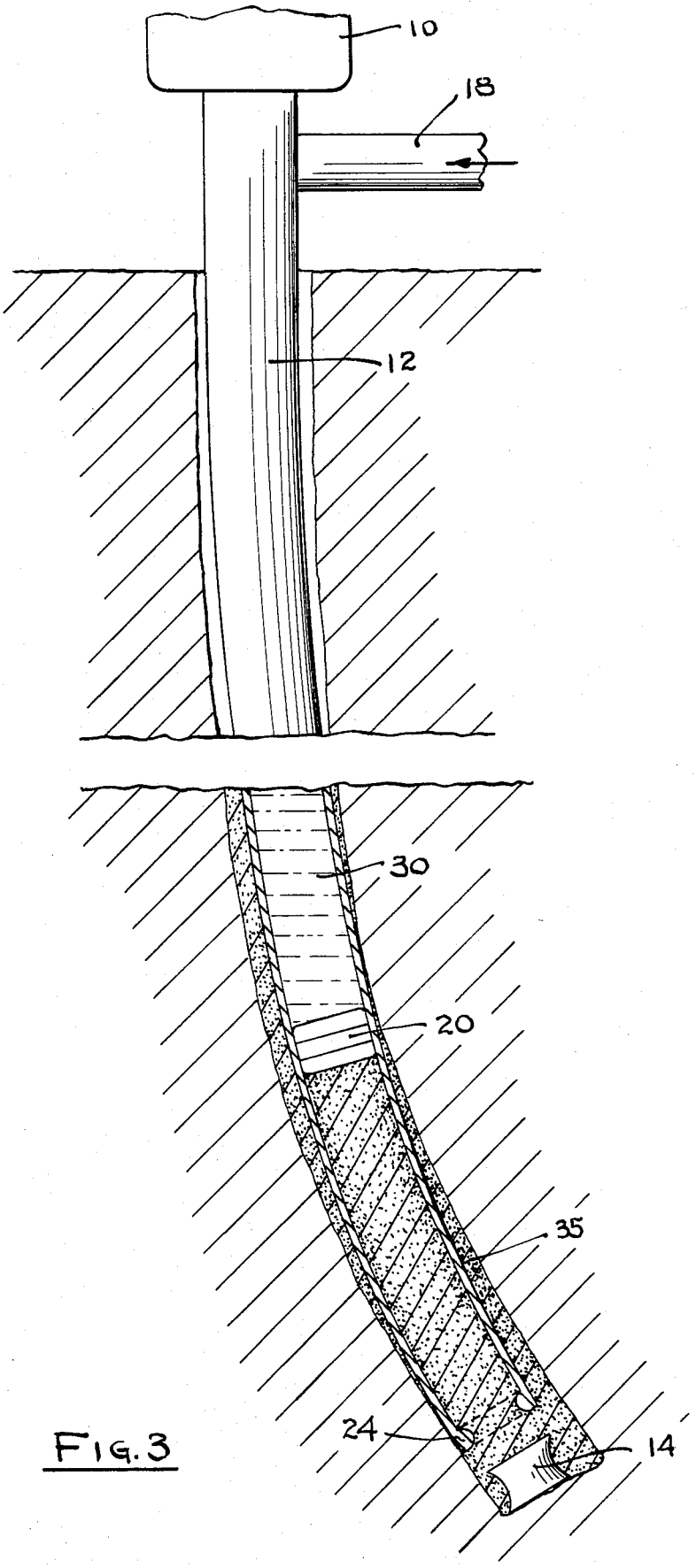
FIG. 3 is a schematic drawing illustrating the carrying out of the final steps of the method of the invention.

Referring now to FIG. 3, when the method amount of cement has been fed into the casing, rigid wiper 20 is installed over this column of cement in the casing, this rigid wiper being made of a relatively inflexible material such as a hard rubber or metal and having a diameter equal to that of the inner diameter of the casing. Water and/or mud is pumped into the casing at inlet 18 to form a column 30 above wiper 20 which drives the wiper downwardly against the concrete column 15, forcing this concrete column out of the bottom of the casing and up along the outer walls thereof to form an annulus thereabout 35. As shown in FIG. 3, the flexible wiper 14 is driven past stop member 24 and out of the bottom of the casing and thus discarded. Rigid wiper 20, however, is retained at the bottom of the casing by stops 24. This provides a pressure buildup of the mud and water 30 at inlet 18 to indicate that all of the cement has been driven out of the casing.

Figure 3A:
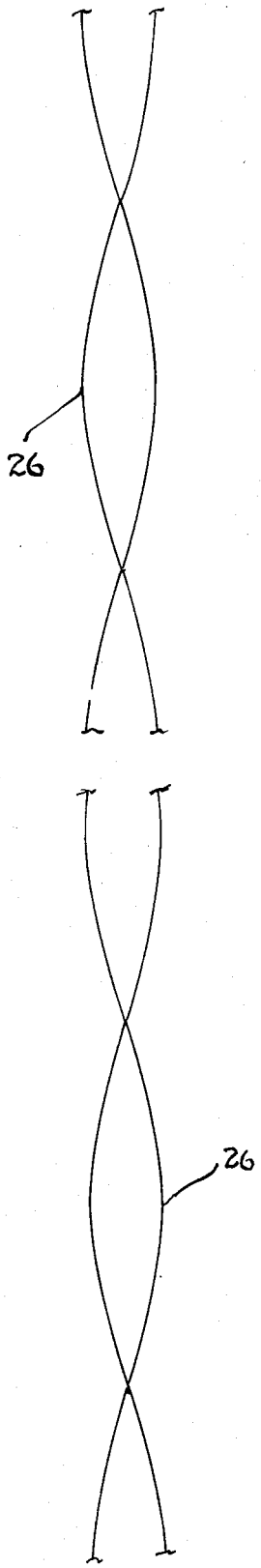
FIG. 3A is a waveform diagram showing the standing wave pattern established in the system of FIG. 3.

As the cement is being driven out of the bottom of casing 12, sonic oscillator 10 is energized preferably to form a standing wave resonant vibration of the casing as indicated by waveforms 26 shown in FIG. 3A. The frequency of oscillator 10 is typically in the range of 15–200 Hz, this frequency being adjusted to produce the resonant standing wave pattern 26 (i.e., resonant vibration) in casing 12.

Since casing 12 is relatively long and narrow, a certain amount of lateral wave action is generated along with the predominantly longitudinal vibrational wave pattern. This is particularly effective in engendering the flow of cement past regions of the casing which bear against the bore wall, such as shown at "A" and "B" in FIG. 1; these lateral vibrations cyclically causing a space to open periodically between the laterally vibrating casing and the well bore, thereby permitting the flow of cement into these areas. The orbiting mass oscillator adjusts its phase angle to accommodate impedance changes in the load as the cement works its way up the annulus and as the cement mixes with mud pockets and becomes densely packed into the annulus. The annulus acts as a waveguide for the sonic pattern that is transmitted into the cement so that high amplitude sonic energy is engenedered in the cement which causes high amplitude sonic fluidization of the cement grains making them free to orient into highly density alignment under the pressure of the long cement annulus. This system of energy transmission is of fairly high impedance, giving a minimum decrease of wave pattern attenuation so that the resonant vibratory wave can act throughout the entire length of the casing. As already noted, the sonic frequency of the oscillator is varied so as to arrive at optimum conditions for aiding the desired objectives, i.e., achieving resonant standing wave vibration. When such a condition is achieved, a lower forcing pressure of the cement pump delivering cement to inlet 18 is noted.

The method of this invention thus is highly effective in producing a good sealing cement annulus around a well casing avoiding the limitations of the prior art in attempting to achieve such an objective.

While the invention has been described and illustrated in detail, it is to be clearly understood that this invention is intended by way of illustration and example only and is not to be taken by way of limitation, the spirit and scope of the invention being limited only by the terms of the following claims.

I claim:

1. A method for forming a cementitious annulus around the outer wall of a well casing comprising the steps of forcing mud, water and other foreign material out of the casing, flowing a column of cement down the casing and out of the bottom thereof such that the cement rises up along the walls of the casing, while the cement is being so cast, applying sonic energy to the casing by means of an orbiting mass oscillator coupled thereto, the frequency of said oscillator being adjusted to cause elastic vibration of said casing so as to release gas bubbles, dirt and other foreign material from the casing surface thereby to wet said surface with the cement to effect a sealing bond between the cement and the casing.

2. The method of claim 1 wherein the frequency of said oscillator is adjusted to cause resonant standing wave vibration of the casing.

3. The method of claim 1 wherein sonic energy is additionally applied to the casing while the mud, water and other foreign material is being forced out of the casing.

4. The method of claim 1 wherein the frequency of the oscillator is adjusted to provide a lowered pressure required for the feeding of cement to the casing.

5. The method of claim 1 wherein the mud, water and other foreign material is forced out of the casing by placing a soft wiper into the casing and driving said wiper downwardly in the casing by feeding a column of cement into the casing onto the wiper.

6. The method of claim 5 wherein the cement is forced out of the casing to form an annulus around the outer wall of the casing by placing a rigid wiper into the casing on top of a column of cement therein and forcing said rigid wiper downwardly by pumping a fluid material into the casing on top of said rigid wiper.

7. The method of claim 5 wherein an annular stop member is provided at the bottom of the casing, the flexible wiper being forced past said stop member out of the casing while the rigid wiper is retained at the bottom of the casing by the stop member to cause a pressure buildup in the casing indicating that all of the cement has been forced out of the casing.

* * * * *